United States Patent [19]

Clardy

[11] Patent Number: 4,853,041

[45] Date of Patent: Aug. 1, 1989

[54] METHOD OF CLEANING A CARPET

[76] Inventor: Bobbie Clardy, 1037 Winding Cir. W, Grapevine, Tex. 76051

[21] Appl. No.: 283,216

[22] Filed: Dec. 12, 1988

Related U.S. Application Data

[63] Continuation of Ser. No. 105,006, Oct. 6, 1987.

[51] Int. Cl.[4] ..... B08B 1/00

[52] U.S. Cl. ..... 134/6; 15/160; 15/DIG. 5

[58] Field of Search ..... 15/DIG. 5, DIG. 6, 160, 15/159 R, 159 A, 172, 167.3, 106, 193, 168, 189; 134/6

[56] References Cited

U.S. PATENT DOCUMENTS 2,280,165 5/1941 Sebastian ..... 15/172

FOREIGN PATENT DOCUMENTS 225048 11/1924 United Kingdom ..... 15/167.3

515233 11/1939 United Kingdom ..... 15/106

*Primary Examiner*—Peter Feldman

*Attorney, Agent, or Firm*—Stanley R. Moore; Thomas L. Crisman

[57] ABSTRACT

A hand held brush specifically adapted for sweeping and cleaning regions of carpet. The brush is constructed with a handle portion in which is secured a field of bristles in a slanted bristle array. The bristle length tapers downwardly from the frontal edge of the brush to the rear edge and the flexibility varies accordingly. In this manner, the bristles may be swept through an area of carpet to remove both large and small dirt and lint particles by utilizing the varying flexibility of the bristles concomittantly with the tapering length thereacross.

3 Claims, 1 Drawing Sheet

METHOD OF CLEANING A CARPET

This is a continuation of application Ser. No. 105,006, filed Oct. 6, 1987.

BACKGROUND OF THE INVENTION

1. Field of the Invention

The present invention relates to brushes and, more particularly, to a carpet brush having a defined bristle construction forming an angulated array and method of cleaning a fibrous area.

2. History of the Prior Art

The prior art is replete with brush designs adapted for a myriad of applications. These brushing implements are used upon a variety of surfaces for removing dust and debris as well as removing unwanted objects from fabrics and rugs. Over the last century, design changes in brush implements have included improvements in both the bristle construction, the bristle array, the brush head and the handle. In the main these improvements have been directed toward improving the efficiency of the brush for the particular application. Long bristled brushes are most widely seen with stiff bristles in the form of brooms. Soft Bristles are used in removing dust and the like. Short bristles are by their nature more rigid and are more commonly seen in human hair brushes and animal brushes.

The construction of a brush appears fairly simple to the layman. In fact, hand made brushes are put together from available materials when necessary. However, commercial brushes designed for specific applications necessitate technical considerations that often go unnoticed by the consumer. Brush bristle texture is one such example. The type of bristle utilized in commercial brushes depends on the particular brush application. Likewise the space in between bristles is dependent on its ultimate use. Hair brushes provide a perfect example because some bristles are spaced far apart to remove tangles while other bristles are spaced in a tighter knit configuration for shaping hair. The same fibers when bunched closer together and in a shorter bristle configuration can then be found in animal brushes where it is necessary to apply a great deal of force to both the hair and the underlying skin. One such hair brush designed specifically for animals is seen in the Furter U.S. Pat. No. 183,758. This 1876 reference teaches a horse brush and the utilization of a bristle array particularly adapted for animal grooming. Tufts of different lengths are distributed evenly across the surface of the brush. This permits the user to apply a combination of pressures against the horse's hair in a technique which is used even today.

Other examples of prior art brush designs include U.S. Pat. No. 4,250,589. This 1981 patent to Pierre Alvin teaches a road sweeping broom constituted by a handle and a bundle of fibers fixed to one of its ends. The invention finds a particular application in the domain of highway equipment. This reference teaches a broom that is both lightweight, has even handling and sweeping power while offering much greater resistance to wear and tear and thus a longer life. One of the features of the invention disclosed therein is the use of synthetic fibers in conjunction with vegetable fibers preferably homogeneously bound together at one of the ends of the broom. Likewise, U.S. Pat. No. 3,315,296 teaches a dusting tool. This 1967 patent to W. P. Richardson teaches the utilization of softer fibers for dusting brushes suitable for sweeping smooth surfaced floors. Again, the bristle configuration was addressed whereby a center brush area comprised relatively short, substantially vertically disposed tufts of bristles extending from a brush back, surrounded by tufts of relatively longer bristles extending from the brush back and flaring outwardly.

Modern brush designs have also addressed applications other than grooming and sweeping. Brushes with short, stiff bristles are used for toothbrushes and one particular bristle array is set forth and shown in U.S. Pat. No. 2,622,259. This 1952 patent to F. E. Chauvin teaches a toothbrush having separate rows of long bristles and short bristles particularly adapted for oral hygiene. The usefulness of the variable bristle length is seen in this particular application which is adapted for the human mouth to maximize effectiveness of brushing. The same holds true in cleaning applications. U.S. Pat. No. 3,087,223 teaches a brush device for napped or pile fabrics. This 1963 patent to M. F. Raw teaches a brush having an angulated array of brush bristles which are particularly adapted for cleaning pile fabrics. It may be seen that the angular orientation of the bristles in conjunction with the adjacent field of bristles afford particular advantages in a cleaning operation. Likewise U.S. Pat. No. 4,042,995 is a more recent patent teaching an improved brush for removing animal hair from carpeting. This 1977 patent to Hyman Varon discloses a field of smooth, tapered, polyethylene teeth which are referred to therein as bristles extending down from the head attached to a broom handle. The density of the bristles at the trailing edge is greater than at the front edge of the broom and the bristles are arranged in a sawtooth leading edge pattern also encompassing a tapered field thereacross. Once the head is attached to a handle it may be pulled across a carpet surface for removing animal hair and the like, which remain in the brush.

Particular bristle configurations are thus seen to be the subject of an every improving technology. The maximum utilization of brushes for the cleaning of carpet has, however, not been the subject of as much technological attention in recent decades due to the advent of the vacuum cleaner. Vacuum cleaners are well known to be the most efficient means for regularly cleaning carpet areas. In certain instances, however, the use of the vacuum cleaner is both cumbersome and inconvenient. Such is the case of small trash spills. In such instances, the use of a brush particularly adapted for cleaning contemporary carpets would be of great help. When dirt, hair or similar debris is left in a carpet due to lack of convenience it has a better chance of becoming lodged deep in the pile and permanently soiling the carpet. A small handbrush particularly adapted for carpets and the manner in which dirt and debris infiltrate carpet fibers would a marked advance over the prior art. Prior art brushes simply do not provide for the removal of lint, debris and small dust particles from carpet piles with the degree of efficiency afforded by a vacuum cleaner. The present invention overcomes the problems of the prior art by providing a carpet brush particularly adapted for removing dirt, lint and debris from upon and between carpet fibers from a simple brushing action. The brush of the present invention is constructed with a tapering bristle array affording both flexibility and rigidity in a configuration particularly adapted for cleaning carpet.

SUMMARY OF THE INVENTION

The present invention relates to brush implements for the cleaning of carpet and method of utilizing such a brush. More particularly, one aspect of the present invention includes a hand-held brush for use in cleaning carpet to remove dirt and debris therefrom with a rolling-brushing motion. The brush implement comprises a brush body comprising a handle for the brush and a plurality of relatively stiff bristles affixed to and depending from the underneath surface of the head. The bristles are constructed to present a defined tapered array whereby the back row of bristles are shorter and resultingly less flexible than the front row of bristles. In this manner, the brush can be pulled through a carpet region with a gentle, rolling hand motion for engaging the carpet with the longer frontal bristles deflecting the carpet in the direction of the brushing motion and the shorter, less flexible backward back bristles going deeper into the carpet for removing dirt and lint therefrom. The various bristle lengths and rigidity result in not only engaging the dirt but also lifting it up from the carpet.

Another aspect of the present invention includes a method of cleaning carpet including the steps of providing a brush having a head and a uniformly tapered field of brush bristles depending therefrom. The method includes providing a brush adapted for cleaning a carpet area comprising a handle, bristles secured to the handle and depending therefrom in a slanted array beneath the handle. The array of bristles comprises a generally flat plane tapering rearwardly for facilitating the angulated engagement of the fibrous region by the brush. The bristles of the brush are formed in bunches, the bunches being secured to the brush handle. The bristles comprise synthetic material. The handle is wooden and is constructed with a plurality of apertures formed in the underside thereof for receipt of the bristles therein. The plane of the sweeping face is disposed at an angle relative to the brush handle on the order of 30°. The sweeping surface of the brush may also be disposed at an angle on the order of 45° relative to the handle of the brush. The bristles of the frontal region of the brush are on the order of two or three times longer than the bristles on the rearmost region of the brush.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
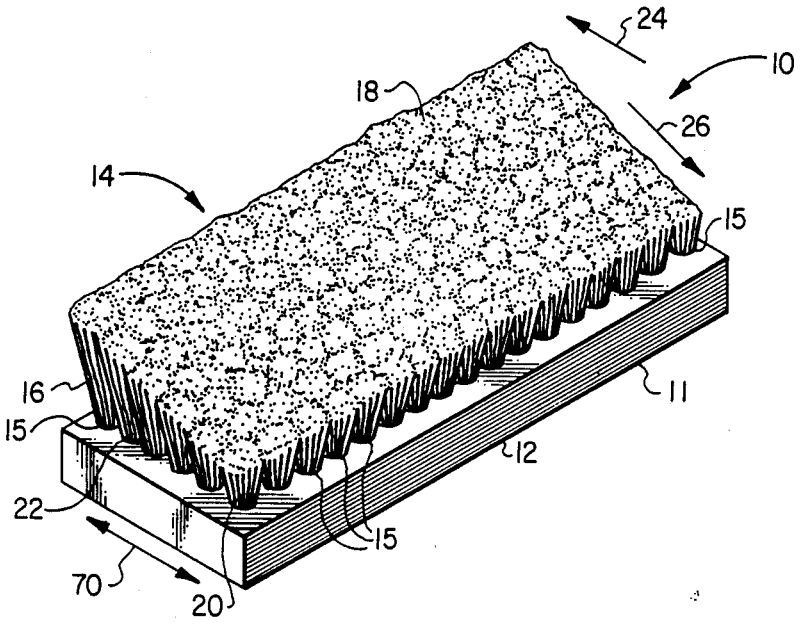
FIG. 1 is a perspective view of the brush of the present invention illustrating the tapered field of bristles comprising the brushing surface.

Referring first to FIG. 1 there is shown one embodiment of a brush 10 constructed in accordance with the principles of the present invention. The brush 10 includes a body 11 forming a head 12 which also serves as a handle for the brush and from which depends a defined, tapered field of bristles 14. The tapered field of bristles 14 present an affective bristle array for the cleaning of carpet or the like wherein long, frontal bristles 16 are made of substantially rigid, straight, relatively stiff material. The underneath side of the bristles 18 are constructed with the tapered array terminating in a relatively short back row of bristles 20. As described in more detail below, the flexibility and functional rigidity of the bristle array 14 varies between the front bristle row 16 and the back bristle row 20 to maximize effectiveness in cleaning a conventional rug or carpet regions.

Still referring to FIG. 1, the handle 12 may be formed of plastic wood or the like as is conventional in brush or broom construction. Likewise the bristles 14 may be constructed of synthetic material of the type which is common for brush bristle manufacture. The bristles 14 are preferably secured in apertures 15 formed in the head 12 in longitudinal rows 22. In this manner the brush 10 provides a cleaning tool designed to be pulled through carpeting by the hand of a user with a gentle sweeping, rolling motion. The longer, flexible frontal bristles 16 are used to deflect the carpet fibers downwardly for exposing the interstitial regions therebetween to the shorter, stiffer bristles within, and at the rear of, the array 14. Most of the bristles are spaced in a substantially tight configuration. As shown herein, the bristles of array 14 are gradually shortened from the front 16 to the back 20 in a direction opposite to that which would ordinarily be considered the direction of sweeping motion. In the present invention the sweeping motion occurs in the direction of arrow 24 which is opposite to the direction of downward taper 26.

Referring still to FIG. 1 the bristle array 14 is constructed to define a taper angle 28 on the order of 30°–45°. With this particular angle the effectiveness of a particular bristle type is maximized. A conventional textile bristle which is most advantageous for a particular surface can be utilized in most instances during manufacture. For example, where a first desired bristle has more rigidity than a second desired bristle, the first desired bristle must be fabricated in a configuration where the frontal flexibility of bristle 16 and the rear rigidity of bristles 20 is sufficiently accommodating for the particular application. For this reason, the frontal bristles 16 may be made longer in certain instances where the surface to be cleaned requires more movement such as a carpet having a longer fibers. However when the type of material being cleaned requires a more rigid cleaning bristle, the rear bristles 20 must be relatively short for providing such rigidity. In this configuration the overall taper angle 28 may increase. Just the opposite is true when the type of bristles used in array 14 are sufficiently rigid. The frontal bristle row 16 may be shortened and the angle 28 reduced. The underlying bristle face 18 although shown herein in its preferred embodiment has a substantially planar surface defined by the terminal ends of the bristles within array 14. It can also embody some degree of irregularities without departing from the spirit and scope of the present invention. It should be noted that the bristles 14 are configured to provide that angle necessary for deflecting the carpet fibers in the direction of arrow 24 and permitting a force to be applied against the back surface of the brush 30 simultaneously therewith. When this combination is utilized, the debris falling within a carpeted area cannot go unreached by the brush 10 and proper motion thereof will cause expulsion of the debris and dirt therefrom. As described in more detail below, this particular design and the accommodating variation of angle 28 as well as the selective utilization of bristle types in array 14 can accommodate a myriad of surfaces and applications. In this manner few types of dirt, lint and hair cannot be removed from a soiled carpet region with the brush 10.

Figure 2:
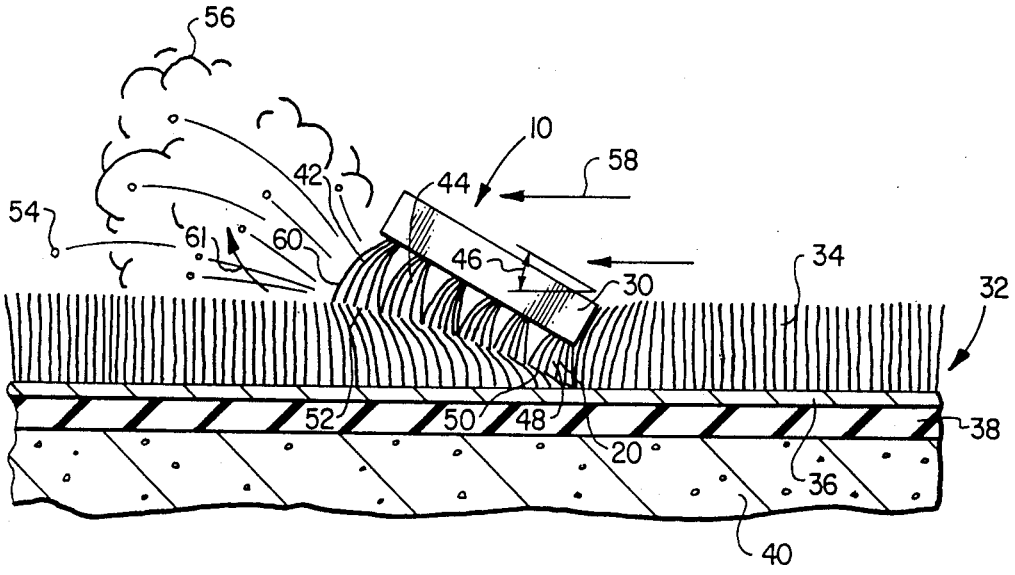
FIG. 2 is an enlarged, side-elevational view of the brush in FIG. 1 engaging a carpet region illustrating the manner of use therewith.

Referring now to FIG. 2, there is shown a side-elevational view of the brush 10 utilized in cleaning a carpet region 32. The carpet 32 is shown to be comprised of a plurality of woven textile yarns 34 upstanding from a backing 36. The carpet backing 36 is laid upon a carpet pad, or cushion 38 which is shown disposed upon a planar floor section 40. This is the conventional cross-sectional configuration of a floor and carpet section upon which the brush 10 can be utilized.

Still referring to FIG. 2, the use of the brush 10 of the present invention is illustrated in some detail. The carpet fibers 34 are engaged by the brush 30 and deflected under the bristle array 14. A front bristle section 42 is shown adjacent a second section of bristles 44. The second bristle section 44 is distinctly shorter than the front bristle section 42 thereby further accentuating the angle of inclination of the brush handle 12 relative to the floor 40. An angle 46 is constructed by the handle 12 due to the pressure upon the rear end of the brush 30 in conjunction with the defined tapered bristle array 14. The rearmost bristle section 48 is thereby permitted to separate adjacent carpet fibers and dig deeply down therein. As shown a carpet yarns section 50 is deflected closer to the backing 36 than the carpet yarns in region 52 which are engaged by the frontal bristles 42. The rear bristles 48 which engage the deflected yarn section 50 are thus able to engage dirt and debris lying therein for removal from the carpet. The debris illustrated as particles 54 and dust 56 is shown being flung away from the brush 30 due to the motion of the brush in the direction of arrows 58 as well as the spring action of the individual brush bristles 60. With a dustpan or the like disposed in front of the brush and beneath the dirt and dust 54 and 56 respectively, the yarns of the carpet 34 can be cleaned of most varieties of substances known to soil the carpet without having to utilize vacuum cleaners or shampoo systems.

Referring still to FIG. 2, the method of utilizing the angulated brush of the present invention is set forth and shown in some detail. The angle of inclination of the brush 30 referred to herein as angle 46 is representative of but one angle afforded by the present design. Numerous angles can be utilized and said angles will vary depending on carpet fiber depth. The important aspect is the rolling-sweeping motion in the direction of arrows 58 with the long fibers 42 engaging the top portions of the carpet yarns 34 prior to the engagement by the rear bristles 20 of those yarns. Due to the fact that the bristle bunches 42–44 are tapered, various sections of the carpet are engaged to facilitate exposing carpet sections and the dirt lodged therein to the sweeping motion. The motion includes the sweeping action of the brush 30 across the carpet and the indentation pressure in the vicinity of the shorter back bristles whereby the brush will strike the orientation shown herein.

The rolling-sweeping motion described herein in the direction of arrow 58 is to be understood to include both a frontal movement of the brush 10 as well as an upward movement of the fibers in the direction of arrow 61. This upward rolling motion in the direction of arrow 61 helps "flick" the debris 54 out of the carpet fibers. A brush constructed in accordance with the principles of the present invention has been shown to be very effective in this type sweeping action for both removing dirt and debris on and in carpet. A brush constructed with a length on the order of 7 inches with a front bristle height of on the order of 2 inches and a back bristle height on the order of ¾ inch has been found to be very suitable. This provides a taper ratio of 2 and 3 to one. The particular ratio of 2.7:1 has proven very effective. The width of the bristle array in the aforesaid brush has been constructed on the order of 2 inches, which width is shown in FIG. 1 as dimension 70. The two inch distance of dimension 70 is but one example of a brush configuration constructed in accordance with the principles of the present invention. What is important is the varied degree of flexibility between the frontal bristle row 16 and the back bristle row 20. As described this bristle height difference is between 1 and 1½ inches (specifically 1¼ inches) with a 2 inch spacing in bristle field width dimension 70. Sufficient depth and flexibility as well as rigidity is thus provided with a bristle field width to height difference on the order of 2:1 to 2:1.5. The significance of this width/height ratio can be appreciated when one compares the efficiency of sweeping a carpet with a conventional broom in a conventional frontal fashion to sweeping with the broom turned sideways onto a carpet. It is well known that utilizing a broom upon a fibrous carpet region in a conventional manner is frustrating due to the fact that the flat frontal broom surface flexes under the force of the carpet and very little debris is lifted. By turning the broom orthogonal to the direction of the sweeping motion the multiple bristle array helps reinforce the debris which is picked up by the frontal bristle fibers. One aspect of this action that may be seen in the present invention with the width 70 provided of sufficient size to afford the pick-up and flicking action by virtue of the taper and width/height ratios defined above.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. A method of cleaning carpet fibers with a brush having a front, rear and bottom surface adapted for use by an operator in said cleaning, said method comprising the steps of:

providing a handle on said brush adapted for being grasped by the operator;

securing bristles to the bottom of said handle to depend therefrom, with said bristles forming a defined array beneath said handle, and said array having a lower sweeping surface defined therebeneath, and having a width defined from front to rear of said brush;

defining a tapered sweeping face on said brush comprising a generally flat plane of bristles the frontal region of which is relatively longer and more flexible than the bristles at the rear of said brush for engaging said carpet with said longer frontal bristles and deflecting said carpet fibers in the direction of brushing motion;

imparting a rolling-sweeping motion and an angulated engagement with said carpet by said brush including imparting both a frontal movement to said brush and an upward movement of said bristles relative to said carpet fibers being cleaned, the longer bristles engaging the top portion of the carpet fibers prior to the engagement by the rear bristles;

disposing said shorter, stiffer bristles in said rear of said brush into said carpet fibers during said rolling-sweeping motion for imparting a flicking action with said shorter bristles in said rear of said brush;

applying an indentation pressure on said handle in the area of said shorter bristles during said frontal movement of said brush for separating adjacent sections of said carpet fibers and exposing the interstitial regions therebetween and permitting said shorter bristles at the rear of said brush to dig deeply therein; and imparting said rolling-sweeping motion across said carpet with said brush in a direction opposite to said taper.

2. The method as set forth in claim 1 and further including the step of angulating said plane of said sweeping face at an angle relative to said brush handle on the order of 30°.

3. The method as set forth in claim 1 and further including the step of angulating said plane of said sweeping surface of said brush at an angle on the order of 45° relative to said handle of said brush.

* * * * *